US008016378B2

(12) United States Patent
Kurokawa et al.

(10) Patent No.: US 8,016,378 B2
(45) Date of Patent: Sep. 13, 2011

(54) ELEMENT SUBSTRATE, PRINTHEAD, AND HEAD CARTRIDGE

(75) Inventors: Tomoko Kurokawa, Yokohama (JP); Nobuyuki Hirayama, Fujisawa (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 391 days.

(21) Appl. No.: 12/265,277

(22) Filed: Nov. 5, 2008

(65) Prior Publication Data

US 2009/0135229 A1 May 28, 2009

(30) Foreign Application Priority Data

Nov. 27, 2007 (JP) ..... 2007-306302

(51) Int. Cl.
*B41J 29/38* (2006.01)

(52) U.S. Cl. ..... 347/12; 347/5; 347/9; 347/10; 347/11

(58) Field of Classification Search ..... None
See application file for complete search history.

(56) References Cited

U.S. PATENT DOCUMENTS 6,290,334 B1 9/2001 Ishinaga et al.
6,302,504 B1 10/2001 Imanaka et al.
7,806,496 B2 * 10/2010 Sakurai ..... 347/9

* cited by examiner

*Primary Examiner* — Uyen-Chau N Le
*Assistant Examiner* — Chad H Smith
(74) *Attorney, Agent, or Firm* — Fitzpatrick, Cella, Harper & Scinto

(57) ABSTRACT

This invention provides an element substrate having a heater selection circuit normally operable even in the use of voltage conversion circuits, which are arranged along the nozzle arrayed direction, each having a small-area in order to reduce the area of the element substrate. The element substrate according to this invention includes a heater selection circuit, which receives a signal output from a voltage conversion circuit, a block selection signal, and a print data signal, and generates and outputs a signal for performing switching by a switching element.

6 Claims, 16 Drawing Sheets

ELEMENT SUBSTRATE, PRINTHEAD, AND HEAD CARTRIDGE

BACKGROUND OF THE INVENTION

1. Field of the Invention

The present invention relates to an element substrate for an inkjet printhead, a printhead having the element substrate, and a head cartridge. Particularly, the present invention relates to an element substrate on which heaters for generating heat energy necessary to discharge ink, and driving circuits for driving them are formed, a printhead having the element substrate, and a head cartridge.

2. Description of the Related Art

As disclosed in the U.S. Pat. No. 6,290,334, the heaters of a conventional inkjet printhead and their driving control circuits are formed on a single element substrate by a semiconductor process. An element substrate which integrates heater and driving control circuits can take a variety of layouts. FIG. 8 shows an example of the layout.

An ink supply port 901 is formed near the center on an element substrate 900 shown in FIG. 8 to supply ink from the lower surface of the element substrate. Heater sections 902, switching element sections 903, heater selection circuit sections 904, voltage conversion circuit sections 905, and shift register sections 906 are arranged to face each other via the ink supply port 901.

Pads 907 of power supply terminals for receiving driving voltages for heaters and respective circuits, and signal terminals for outputting various signals to them are arranged on the shorter sides of the element substrate 900, and connected to heaters and respective circuits via aluminum wiring lines.

A printhead which employs, for example, an NMOS transistor as a heater switching element needs to improve the drivability of the NMOS transistor. For this purpose, the voltage conversion circuit section 905 is arranged to apply, to the gate of the NMOS transistor, a voltage VHT obtained by boosting a driving voltage VDD for a logic circuit on the element substrate, as disclosed in the U.S. Pat. No. 6,302,504. There has conventionally been known a circuit arrangement which employs a voltage of about 3.3 V or 5 V as the driving voltage VDD.

FIG. 9 is a block diagram showing an example of conventional heaters and their driving control circuits. In FIG. 9, a heater 101 serves as a printing element. An NMOS transistor 102 serves as a switching element for driving each heater. A heater selection circuit 1003 receives logical signals, and calculates the logical product. A shift register (S/R) +latch (Latch) 104 stores, in synchronism with a clock signal CLK, a block control signal input as a serial signal from the printing apparatus main body, and latches it in accordance with a latch signal LT. A 1-bit shift register+latch 105 stores, in synchronism with the clock signal, print data DATA input as a serial signal from the printing apparatus main body, and latches it in accordance with the latch signal. A block selection circuit (X to N Decoder) 106 decodes an X-bit block control signal input from the printing apparatus main body to select one of N block selection signal lines in accordance with a block selection signal BLE. At the end of the element substrate, N voltage conversion circuits A 107 are arranged, corresponding to the number (N) of block selection signal lines. One of M voltage conversion circuits 1008 is arranged in a corresponding one of adjacent groups 110 each including N heaters 101, N NMOS transistors 102, and N heater selection circuits 1003.

M 1-bit shift registers+latches 105 are arranged in correspondence with groups 1 to M. The output of each 1-bit shift register is connected to the input of an adjacent 1-bit shift register. The output of the 1-bit latch 105 is connected to the input of the voltage conversion circuit 1008 of a corresponding group. The output of the voltage conversion circuit 1008 is connected to the input of the heater selection circuit 1003 of a corresponding group. The output of each voltage conversion circuits A 107 arranged at the end of the element substrate is connected to the inputs of the heater selection circuits 1003 in a corresponding one of blocks 1 to N in groups 1 to M. In FIG. 9, the 1-bit shift registers+latches 105 each functions as 1-bit shift registers, and form an M-bit shift register as a whole.

The operations of the heaters and their driving control circuits shown in FIG. 9 will be explained with reference to the timing chart of FIG. 10.

M-bit data corresponding to print data DATA are serially transferred to the shift register+latch 104 and 1-bit shift registers+latches 105 in synchronism with the clock signal CLK. The latch signal LT changes to High, and the print data is input to the 1-bit shift registers+latches 105. The signal level of a predetermined one of M output lines extending from the 1-bit shift registers+latches 105 changes to High in accordance with the print data.

Similarly, X-bit block control signals are also serially input to the shift register+latch 104 in synchronism with the clock signal. Then, the latch signal changes to High, and the X-bit block control signals are input to the block selection circuit 106. The timing of the block selection signal BLE output from the block selection circuit 106 to an output line 112 corresponds to the timing of BLE in FIG. 10. The X-bit block control signals select one of N voltage conversion circuits A 107 to which the block selection signal is input. A predetermined heater is selected by a heater selection circuit 1003 selected by a High block control signal from M heater selection circuits 1003 commonly connected to one output signal extending from the voltage conversion circuit A 107. A current I flows through the selected heater in accordance with a heating enable signal HE, thereby driving the heater.

The above-described operation is sequentially repeated N times. As a result, M×N heaters can be time-divisionally driven every M heaters at N timings, thereby driving all the heaters.

Similar to the voltage conversion circuit section 905 shown in FIG. 8, the voltage conversion circuit A 107 and voltage conversion circuit 1008 shown in FIG. 9 are arranged to apply, to the gate of the NMOS transistor, the voltage VHT obtained by boosting the driving voltage VDD for a logic circuit on the element substrate.

FIG. 11 is a circuit diagram showing the voltage conversion circuit 1008.

In FIG. 11, reference numerals 1201 to 1210 denote building elements of the voltage conversion circuit 1008. The terminal IN 1201 receives a signal output from a logic circuit such as the block selection circuit. The inverter 1202 inverts the logic of a signal input from the terminal IN 1201 to output the inverted signal. The MOS transistors 1203 to 1208 form a voltage converter which converts the voltage of a signal. The inverter 1209 buffers a signal output from the voltage conversion circuit 1008. The terminal OUT 1210 outputs a voltage-converted signal.

A signal input to the terminal IN 1201 is input to the gates of the PMOS transistor 1207 and NMOS transistor 1206, and the inverter 1202. A signal logic-inverted by the inverter 1202 is input to the gates of the PMOS transistor 1204 and NMOS transistor 1203. A signal input to the terminal IN 1201 and a signal output from the inverter 1202 have the voltage VDD.

When a signal of the voltage VDD is input to the terminal IN 1201, a voltage of 0 V is applied to the gates of the MOS transistors 1203 and 1204 because the inverted signal of the signal input to the terminal IN 1201 is input to them. The voltage VDD is applied to the gates of the MOS transistors 1206 and 1207 because a signal input to the terminal IN 1201 is directly input to them. At this time, the gate of the NMOS transistor 1206 is turned on to connect its drain to ground GND at low impedance. The drain of the NMOS transistor 1206 is connected to the gate of the PMOS transistor 1205. Thus, the gate of the PMOS transistor 1205 is connected to GND at low impedance to turn on the PMOS transistor 1205. The gate of the PMOS transistor 1204 series-connected to the PMOS transistor receives an output signal from the inverter 1202, so the gate voltage of the PMOS transistor 1204 becomes 0V. At this time, the PMOS transistor 1204 remains ON regardless of whether VDD or 0 V is applied to its gate. This is because the PMOS transistor 1205 is ON, and the source voltage of the PMOS transistor 1204 is VHT higher than VDD. Further, the gate voltage of the NMOS transistor 1203 series-connected to the PMOS transistor is 0 V, so the NMOS transistor 1203 is turned off. Since the PMOS transistors 1205 and 1204 are ON and the NMOS transistor 1203 is OFF, the voltage of a node connected to the drains of the PMOS transistor 1204 and NMOS transistor 1203 and the gate of the PMOS transistor 1208 becomes the power supply voltage VHT of the voltage conversion circuit. Since the gate voltage of the PMOS transistor 1208 changes to VHT, the PMOS transistor 1208 is turned off. Since the NMOS transistor 1206 is ON, the voltage of a node connected to the drains of the PMOS transistor 1207 and NMOS transistor 1206 and the gate of the PMOS transistor becomes 0 V. An output signal from the inverter connected to this node serves as an output signal from the voltage conversion circuit A. Since the voltage of the node connected to the inverter 1209 is 0 V, a signal of the voltage VHT is output from the terminal OUT 1210.

When the level of a signal input to the terminal IN 1201 is Low, the logic of each element of the voltage conversion circuit A becomes opposite to the above-mentioned one. Thus, no signal is output from the terminal OUT 1210.

FIG. 12 is a circuit diagram showing the heater selection circuit 1003 in FIG. 9.

The heater selection circuit 1003 includes two PMOS transistors 1301 and 1302 series-connected to a power supply for outputting the voltage VHT. The heater selection circuit 1003 also includes two NMOS transistors 1303 and 1304, whose drains are connected to that of the PMOS transistor 1302, parallel-connected to the PMOS transistor 1302. The heater selection circuit 1003 takes a two-input NOR circuit in which the gates of the PMOS transistor 1301 and NMOS transistor 1303 are connected to the terminal IN1, and those of the PMOS transistor 1302 and NMOS transistor 1304 are connected to the terminal IN2. When both the terminals IN1 and IN2 receive High signals, a signal output from the terminal OUT changes to Low. In other cases, a signal output from the terminal OUT also changes to HIGH, outputting the voltage VHT. The terminals IN1 and IN2 receive signals with an amplitude of 0 V to VHT boosted up to the voltage VHT by the voltage conversion circuit, selecting a heater.

FIG. 13 is a timing chart showing the input timings of input signals to the voltage conversion circuit and the application timing of the gate voltage to the NMOS transistor serving as a switching element when driving a heater on a conventional element substrate.

A print data signal HEAT output from a print data supply circuit to determine a timing to supply a driving current to a heater is input with an amplitude of 0 V to VDD to the terminal IN of the voltage conversion circuit. In response to the timing of HEAT, a current IHT consumed by a power supply for driving an NMOS transistor serving as a switching element transiently flows at the leading and trailing edges of the HEAT pulse.

An NMOS transistor serving as a switching element corresponding to a heater selected as a heater to be driven is connected to the voltage conversion circuit. A signal OUT_on (VG_on) with an amplitude of 0 V to VHT is applied to the gate of the NMOS transistor. The signal OUT_on is obtained by converting the voltage of HEAT. The NMOS transistor serving as a switching element to which OUT_on is applied to its gate is turned on while a gate voltage equal to or higher than a threshold Vth is applied. A 50-mA current IH_on flows through a corresponding heater.

To the contrary, no voltage is applied to an NMOS transistor serving as a switching element corresponding to a heater not selected as a heater to be driven, as represented by OUT_off (VG_off). As represented by IH_off, no current flows through a corresponding heater.

Recently, the above-described inkjet printing apparatus is increasing the nozzle arrangement density in order to implement high-speed, high-quality printing. The inkjet printing apparatus which prints by scanning the printhead can increase the width of printing by one scanning by increasing the number of heaters in order to achieve high-speed printing. However, this increases the area of the element substrate of the printhead. Also, the inkjet printing apparatus can downsize a droplet discharged from the printhead in order to achieve high-quality printing. In this case, to prevent a decrease in printing speed while downsizing the droplet, the number of nozzles must be increased to arrange them at high density. As a result, heater driving circuits and the like must be arranged on the element substrate in correspondence with a narrow heater pitch, increasing the area of the element substrate in a direction perpendicular to the nozzle arrayed direction. The increase in the area of the element substrate raises the cost. The length of the element substrate in the nozzle arrayed direction is determined by the printing width. To reduce the area of the element substrate, the length in a direction perpendicular to the nozzle arrayed direction must be shortened.

On an element substrate having the conventional arrangement shown in FIG. 8, shift registers are arranged along the nozzle arrayed direction. On the element substrate, data flows through the shift register, voltage conversion circuit, and heater selection circuit in the order named. The voltage conversion circuit and heater selection circuit must be interposed between the shift register and the heater. Thus, the voltage conversion circuit and heater selection circuit are also arranged along the nozzle arrayed direction in accordance with the arrangement of the heater and shift register. The above-described voltage conversion circuit has many building elements in order to prevent a breakthrough current from flowing. These building elements occupy a large area of the element substrate in the nozzle arrayed direction. A circuit, such as the voltage conversion circuit, which needs to operate at high voltage must have a high-voltage tolerant structure in order to ensure tolerance against high voltage. However, integration for the high-voltage tolerant structure is limited, and it is difficult to integrate elements at high density. As another conceivable countermeasure except for the high-density integration, the number of building elements such as transistors may also be reduced. However, each transistor which forms a conventional voltage conversion circuit is necessary to cut off a current flowing through the voltage conversion circuit upon switching.

SUMMARY OF THE INVENTION

Accordingly, the present invention is conceived as a response to the above-described disadvantages of the conventional art.

For example, an element substrate according to this invention includes a heater selection circuit normally operable even in the use of voltage conversion circuits, that hardly occupy the area on an element substrate, arranged along the nozzle arrayed direction on the element substrate. A printhead and head cartridge according to this invention use the element substrate.

According to one aspect of the present invention, preferably, there is provided an element substrate having a plurality of heaters, and a plurality of switching elements corresponding to the plurality of heaters, the substrate comprising: an inverter (111) which receives a print data signal, inverts logic of the print data signal, and outputs an inverted signal; a voltage conversion circuit (108) which receives the inverted signal, inverts logic of the inverted signal, converts a voltage of the logic-inverted signal, and outputs the voltage-converted signal; a block selection circuit which outputs a block selection signal for time-divisionally driving the plurality of heaters for each block; and heater selection circuits (103), arranged in correspondence with the plurality of switching elements, which receive the signal output from the voltage conversion circuit, the block selection signal, and the print data signal, and output signals for performing switching by the plurality of switching elements, wherein the voltage conversion circuit (108) includes: an NMOS transistor (201) having a gate connected to an input terminal of the inverted signal, and a source grounded; and a PMOS transistor (202), series-connected to the NMOS transistor, which has a source connected to a power supply for outputting a voltage for driving the plurality of switching elements, and a gate and drain short-circuited, and each of the heater selection circuits (103) includes: a PMOS transistor (301) having a gate connected to an input terminal of the signal output from the voltage conversion circuit, and a source connected to the power supply for outputting the voltage for driving the plurality of switching elements; a PMOS transistor (302), series-connected to the PMOS transistor (301), which has a gate connected to an input terminal of the block selection signal, and a drain connected to an output terminal of the signal for performing the switching; an NMOS transistor (304) having a gate connected to an input terminal of the print data signal, a drain connected to the output terminal of the signal for performing the switching, and a source grounded; and an NMOS transistor (303), parallel-connected to the NMOS transistor (304), which has a gate connected to the input terminal of the block selection signal.

According to another aspect of the present invention, preferably, there is provided an element substrate having a plurality of heaters, and a plurality of switching elements corresponding to the plurality of heaters, the substrate comprising: an inverter (111) which receives a print data signal, inverts logic of the print data signal, and outputs an inverted signal; a voltage conversion circuit (108) which receives the inverted signal, inverts logic of the inverted signal, converts a voltage of the logic-inverted signal, and outputs the voltage-converted signal; a block selection circuit which outputs a block selection signal for time-divisionally driving the plurality of heaters for each block; and heater selection circuits (103), arranged in correspondence with the plurality of switching elements, which receive the signal output from the voltage conversion circuit, the block selection signal, and the print data signal, and output signals for performing switching by the plurality of switching elements, wherein the voltage conversion circuit (108) includes: an NMOS transistor (201) having a gate connected to an input terminal of the inverted signal, and a source grounded; and a PMOS transistor (202), series-connected to the NMOS transistor, which has a source connected to a power supply for outputting a voltage for driving the plurality of switching elements, and a gate and drain short-circuited, and each of the heater selection circuits (103) includes: a NAND circuit including: a PMOS transistor (601) having a gate connected to an input terminal of the signal output from the voltage conversion circuit, and a source connected to the power supply for outputting a voltage for driving the plurality of switching elements; a PMOS transistor (602), parallel-connected to the PMOS transistor, which has a gate connected to an input terminal of the block selection signal; an NMOS transistor (603) having a drain connected to drains of the two PMOS transistors (601, 602), and a gate connected to the input terminal of the block selection signal; and an NMOS transistor (604), series-connected to the NMOS transistor (603), which has a gate connected to an input terminal of the print data signal, and a source grounded; and an inverter including: a PMOS (605) transistor which has a gate connected to a drain of the NMOS transistor (603) having the drain connected to the drains of the two PMOS transistors (601, 602) of the NAND circuit and the gate connected to the input terminal of the block selection signal, and has a source connected to the power supply for outputting the voltage for driving the plurality of switching elements; and an NMOS transistor (606), series-connected to the PMOS transistor (605), which has a gate connected to the drain of the NMOS transistor (603) having the drain connected to the drains of the two PMOS transistors (601, 602) of the NAND circuit and the gate connected to the input terminal of the block selection signal, and has a source grounded.

According to still another aspect of the present invention, preferably, there is provided a printhead using the above-mentioned element substrate.

According to still another aspect of the present invention, preferably, there is provided a head cartridge comprising a printhead using the above-mentioned element substrate and an ink tank containing ink.

The invention is particularly advantageous since it can provide an element substrate having on it voltage conversion circuits which are arranged along the nozzle arrayed direction and hardly occupy the area, and a heater selection circuit which operates normally even in the use of the voltage conversion circuits. In addition, the invention can provide a printhead having the element substrate, and a head cartridge.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "nozzle" generally means a set of a discharge orifice, a liquid channel connected to the orifice and an element to generate energy utilized for ink discharge.

The term "element substrate" in the description not only includes a simple substrate made of a silicon semiconductor, but also broadly includes a substrate with elements, wiring lines, and the like.

The expression "on a substrate" not only includes "on an element substrate", but also broadly includes "on the surface of an element substrate" and "inside of an element substrate near its surface". The term "built-in" in this invention not only includes "simply arrange separate elements on a substrate", but also broadly includes "integrally form and manufacture elements on an element substrate by a semiconductor circuit manufacturing process or the like".

Figure 14:
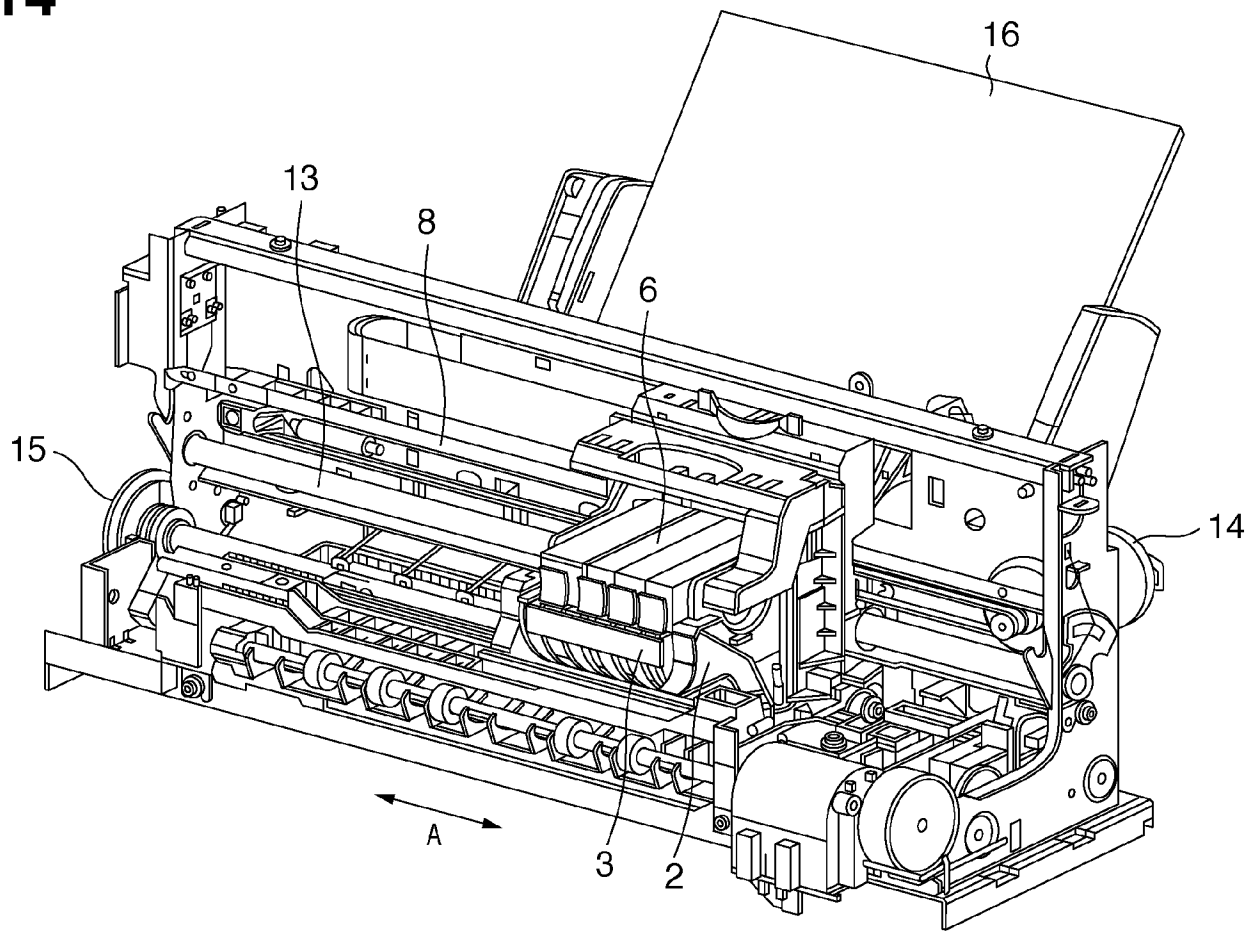
FIG. 14 is a schematic perspective view showing the outer appearance of the structure of an inkjet printing apparatus as a typical embodiment of the present invention.

FIG. 14 is a schematic perspective view showing the outer appearance of the structure of an inkjet printing apparatus as a typical embodiment of the present invention.

As shown in FIG. 14, the inkjet printing apparatus (to be referred to as a printing apparatus hereinafter) includes a printhead 3 which prints by discharging ink according to the inkjet method. A transmission mechanism 4 transmits a driving force generated by a carriage motor 14 to a carriage 2 supporting the printhead 3 to reciprocate the carriage 2 in directions (main scanning direction) indicated by an arrow A (reciprocal scanning). Along with this reciprocal scanning, a print medium 16 such as print paper is fed via a paper feed mechanism 5 and conveyed to a print position. At the print position, the printhead 3 prints by discharging ink to the print medium 16.

The carriage 2 of the printing apparatus supports not only the printhead 3, but also an ink tank 6 which contains ink to be supplied to the printhead 3. The ink tank 6 is detachable from the carriage 2.

The printing apparatus shown in FIG. 14 can print in color. For this purpose, the carriage 2 supports four ink tanks which respectively contain magenta (M), cyan (C), yellow (Y), and black (K) inks. The four ink tanks are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with a print signal. In particular, the printhead 3 according to the embodiment includes a heater formed from a resistor. A pulse voltage is applied to the heater to discharge ink from an orifice corresponding to the heater.

As shown in FIG. 14, the carriage 2 reciprocates along a guide shaft 13 by normal rotation and reverse rotation of the carriage motor 14. A scale 8 representing the position of the carriage 2 is arranged along the main scanning direction (directions indicated by the arrow A) of the carriage 2.

The printing apparatus has a platen (not shown) facing the orifice surface of the printhead 3 having orifices (not shown). The carriage 2 supporting the printhead 3 reciprocates by the driving force of the carriage motor 14. At the same time, the printhead 3 receives a print signal to discharge ink and print by the entire width of the print medium 16 conveyed onto the platen.

Figure 16:
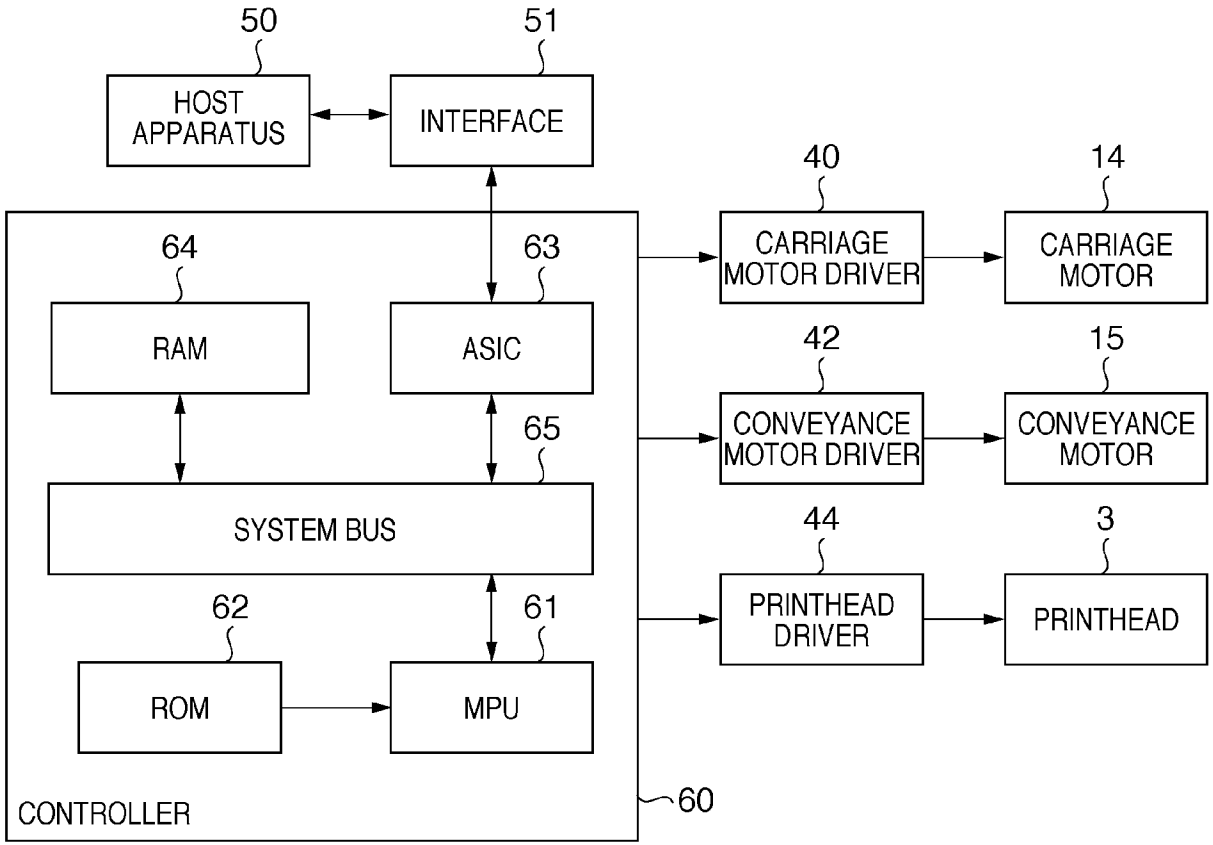
FIG. 16 is a block diagram showing the control arrangement of the inkjet printing apparatus.

FIG. 16 is a block diagram showing the control arrangement of the printing apparatus shown in FIG. 14.

As shown in FIG. 16, a controller 60 includes a MPU 61, and a ROM 62 which stores a predetermined table and other permanent data. The controller 60 also includes an ASIC (Application Specific Integrated Circuit) 63 which generates control signals for controlling the carriage motor 14, a conveyance motor 15, and the printhead 3. The controller 60 further includes a RAM 64 having a print data rasterization area, a work area for executing a program, and the like. The controller 60 also includes a system bus 65 which connects the MPU 61, ASIC 63, and RAM 64 to each other and allows exchanging data.

Reference numeral 50 denotes a computer which serves as an image data supply source and is generically named a host apparatus. The host apparatus 50 and printing apparatus transmit/receive print data, commands, status signals, and the like via an interface (I/F) 51.

A carriage motor driver 40 drives the carriage motor 14, and a conveyance motor driver 42 drives the conveyance motor 15. A printhead driver 44 drives the printhead 3.

Figure 15:
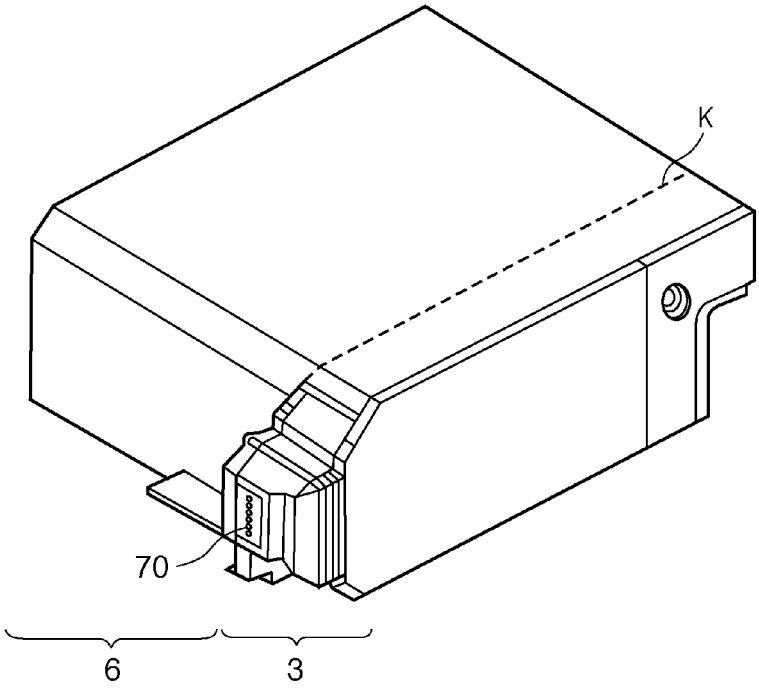
FIG. 15 is a perspective view of a general head cartridge.

FIG. 15 is a perspective view showing the outer appearance of the structure of a head cartridge which integrates an ink tank and printhead. In FIG. 15, a dotted line K indicates the boundary between the ink tank 6 and the printhead 3. The head cartridge has an electrode (not shown) to receive an electrical signal supplied from the carriage 2 when the head cartridge is mounted on the carriage 2. The electrical signal drives the printhead 3 to discharge ink.

In FIG. 15, reference numeral 70 denotes an ink orifice array.

Embodiments of an element substrate used in the printhead of the printing apparatus having the above-described arrangement will be described.

First Embodiment

Figure 1:
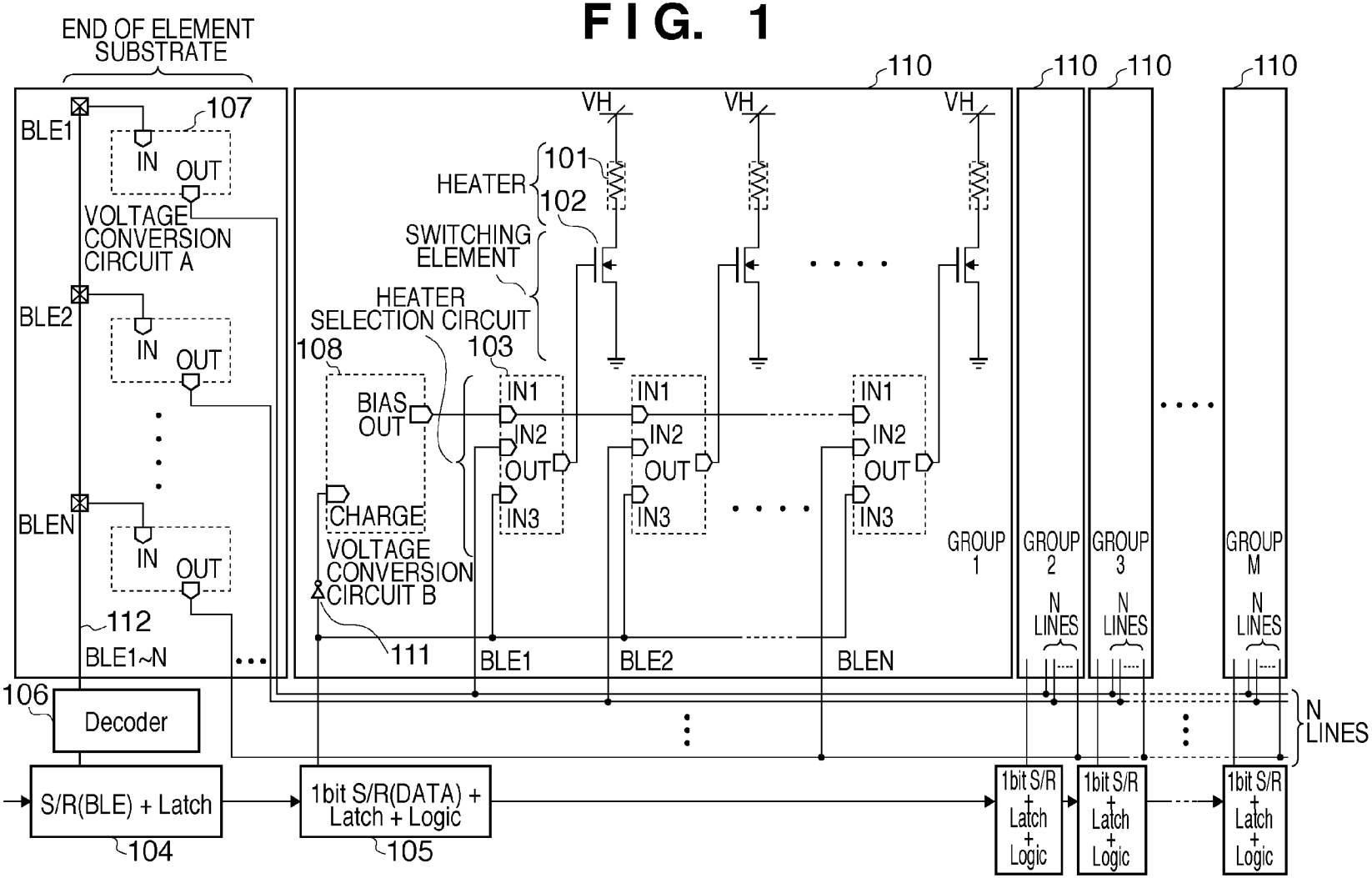
FIG. 1 is a block diagram showing an example of heaters and their driving control circuits according to the first embodiment of the present invention.
Figure 9:
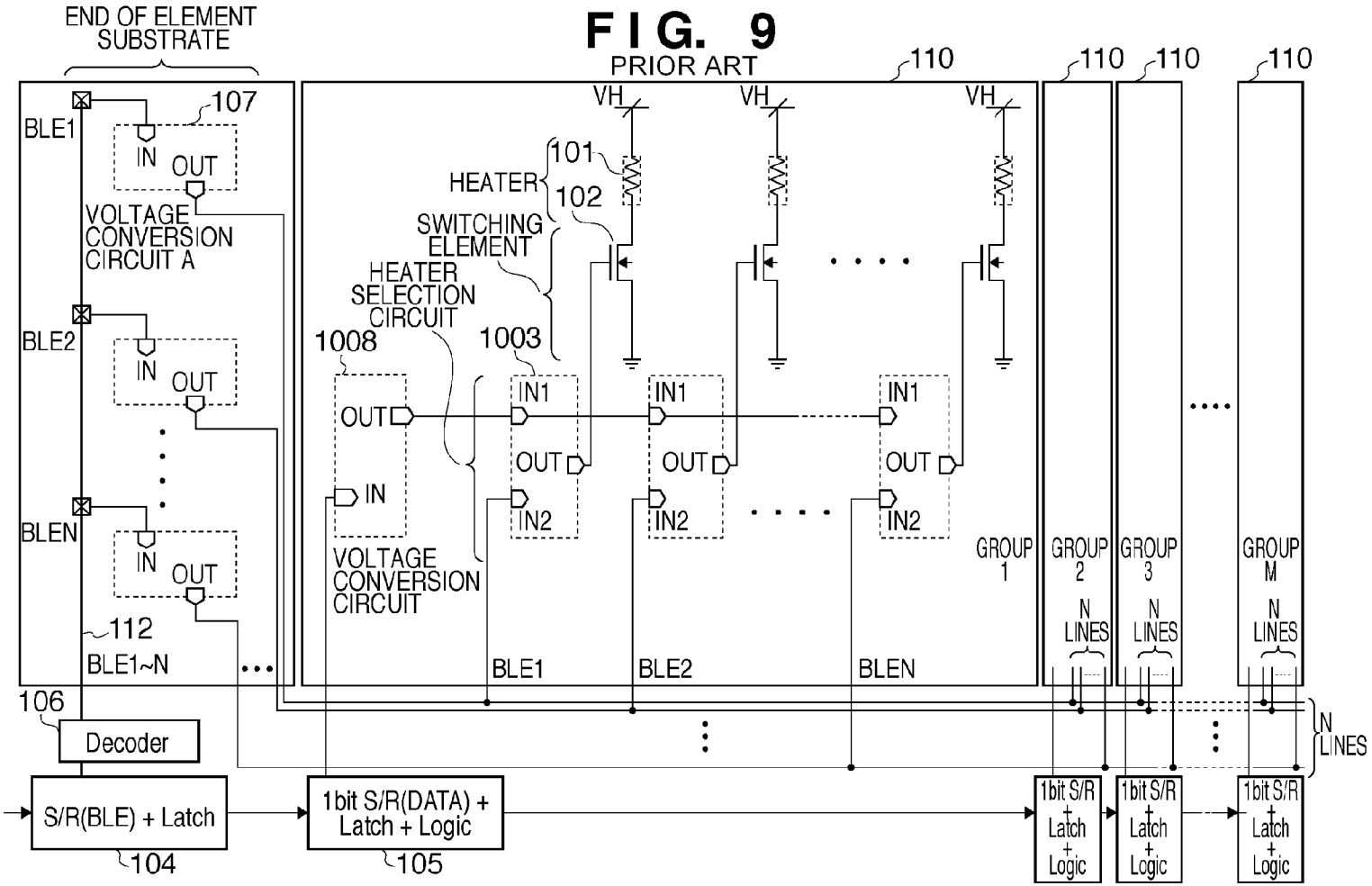
FIG. 9 PRIOR ART
FIG. 9 is a block diagram showing an example of conventional heaters and their driving control circuits.
Figure 10:
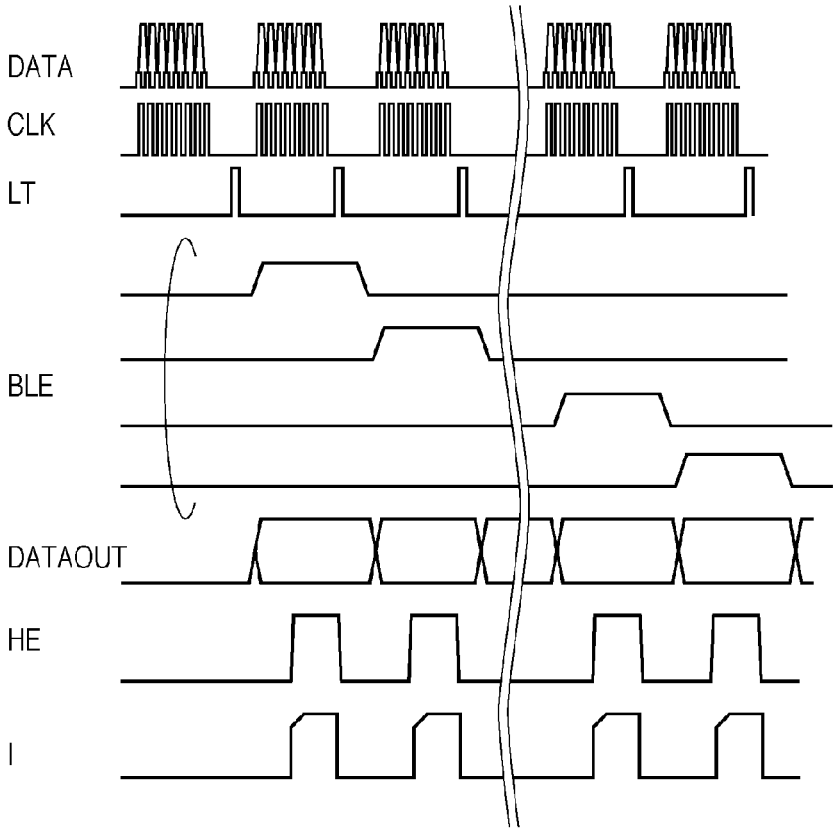
FIG. 10 PRIOR ART
FIG. 10 is a timing chart for explaining the operations of the conventional heaters and their driving control circuits.
Figure 11:
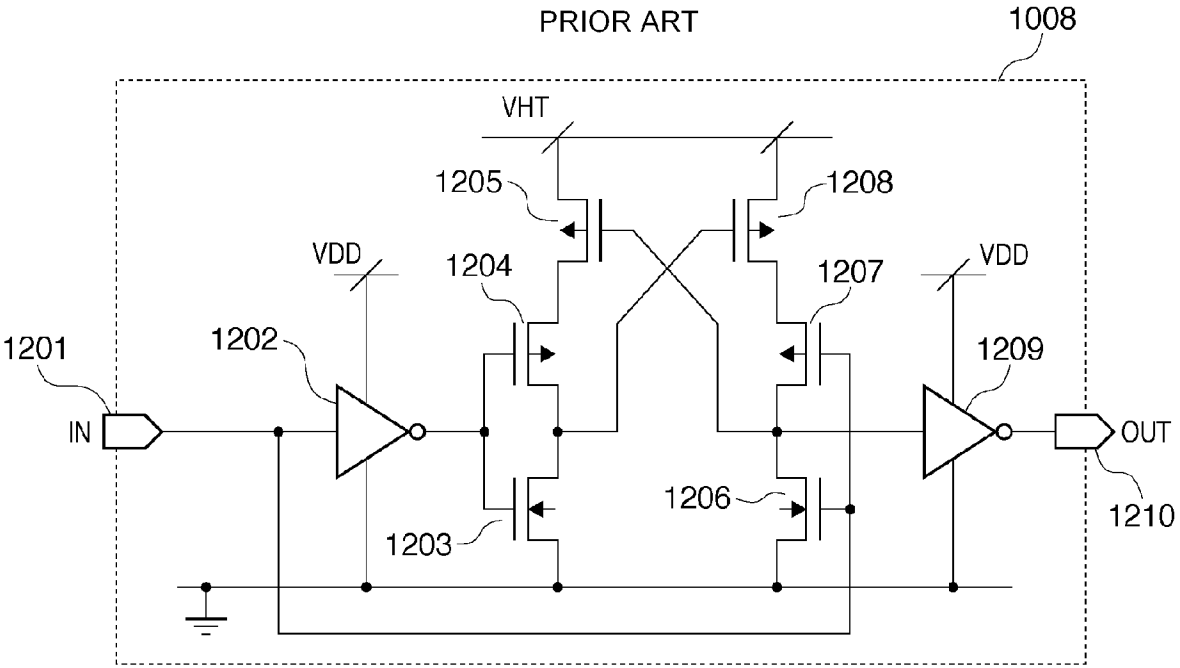
FIG. 11 PRIOR ART
FIG. 11 is a circuit diagram showing a conventional voltage conversion circuit.

FIG. 1 is a block diagram showing an example of an equivalent circuit including a voltage conversion circuit A, a voltage conversion circuit B, a heater, a MOS transistor serving as a switching element, and a heater selection circuit, and is used for explaining the first embodiment. This block diagram schematically shows the layout of circuits on an element substrate. Unlike the conventional element substrate shown in FIG. 9, the element substrate of the first embodiment uses a voltage conversion circuit B 108 instead of the voltage conversion circuit 1008 shown in FIG. 9, and a heater selection circuit 103 instead of the heater selection circuit 1003 shown in FIG. 9. The element substrate has an inverter 111 which inverts a print data signal to output the inverted signal to the voltage conversion circuit B. A description of the arrangement common to FIG. 9 will not be repeated.

Figure 2:
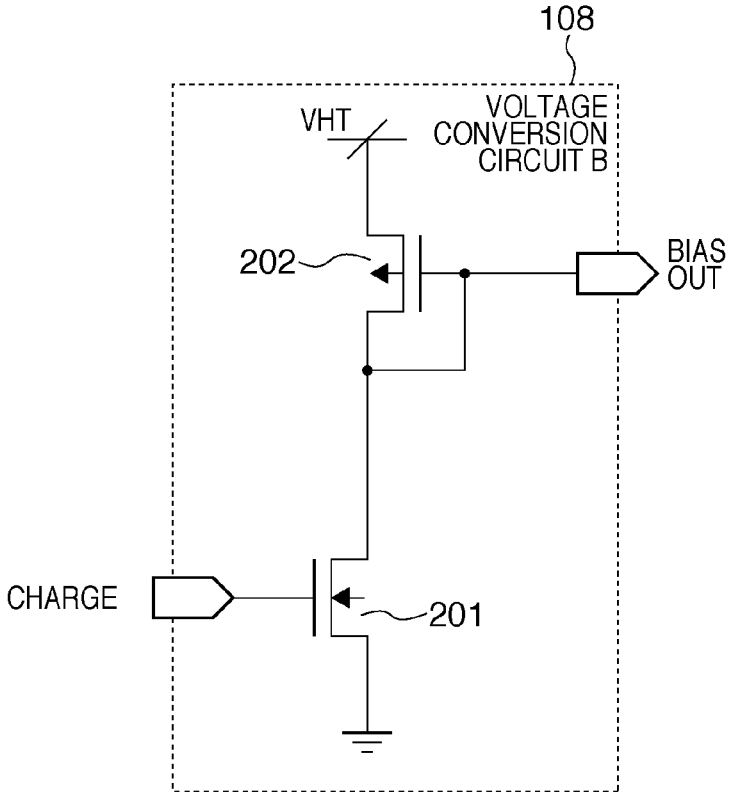
FIG. 2 is a circuit diagram showing a voltage conversion circuit which reduces the number of building elements.

One of M voltage conversion circuits B 108 shown in FIG. 2 is arranged in a corresponding one of groups 110. The voltage conversion circuit B 108 includes an NMOS transistor having a gate connected to the terminal CHARGE serving as an input terminal for a print data signal inverted by the inverter, and a source grounded. The voltage conversion circuit B 108 also includes a PMOS transistor which is series-connected to the NMOS transistor and has a source connected to a power supply for outputting a voltage for driving a MOS transistor serving as a switching element, and a gate and drain short-circuited.

The voltage conversion circuit B 108 includes an NMOS transistor 201 having a gate connected to the terminal CHARGE for receiving a signal with an amplitude of 0 V to VDD from an external logic circuit. The voltage conversion circuit B 108 also includes a PMOS transistor 202 having a source connected to a power supply for outputting the voltage VHT, and a node between a short-circuited gate and drain connected to the terminal BIAS OUT and the drain of the NMOS transistor 201.

The operation of the voltage conversion circuit B will be described.

For example, when the voltage VDD is applied to the terminal CHARGE to change the signal level to High, the NMOS transistor 201 is turned on. The gate voltage of the PMOS transistor 202 is determined by a current flowing through the PMOS transistor 202 at this time, and an effective resistance while the NMOS transistor 201 is ON. This gate voltage is output from the terminal BIAS OUT.

When the voltage of the terminal CHARGE is applied to change the signal level to Low, the NMOS transistor 201 is turned off to disconnect the PMOS transistor 202 from the NMOS transistor 201. At this time, since the gate and drain of the PMOS transistor 202 are short-circuited, the PMOS transistor 202 behaves like a diode, and the drain voltage becomes almost equal to the voltage VHT. As a result, the voltage VHT is applied to the gate of the PMOS transistor 202, outputting the voltage VHT from the terminal BIAS OUT. In the voltage conversion circuit B shown in FIG. 2, the logic input to the terminal CHARGE is inverted with the amplitude of the voltage VHT, and output from the terminal BIAS OUT.

The voltage conversion circuit B 108 which operates in the above-described way can reduce the number of building components. However, while logical signal level High is input (logical signal level Low is output), the power supply current keeps flowing through ground via the PMOS and NMOS transistors.

Figure 4:
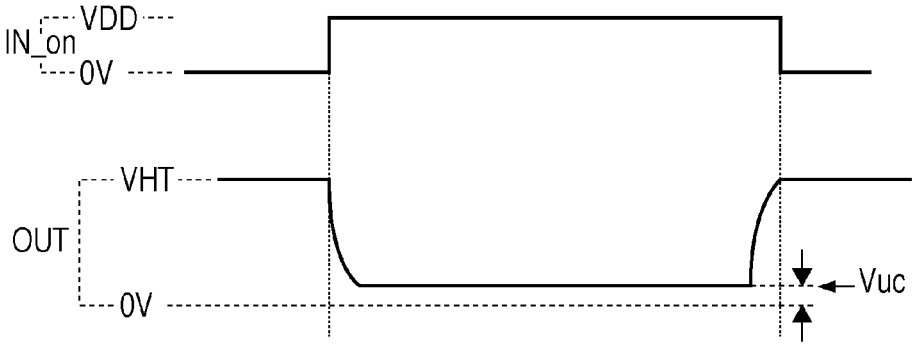
FIG. 4 is a timing chart of the voltage conversion circuit which reduces the number of building elements.

FIG. 4 is a timing chart of the voltage conversion circuit B in FIG. 2.

Assume that a signal with an amplitude of VDD is input to the terminal CHARGE, as represented by IN_on in FIG. 4. When the level of a signal input to the terminal CHARGE is Low, the terminal BIAS OUT is pulled up to the voltage VHT, the logical signal level changes to High, and the terminal BIAS OUT outputs the voltage VHT, as represented by OUT in FIG. 4. While the signal having the amplitude of VDD is input to the terminal CHARGE, the NMOS transistor 201 remains ON. However, an output from the terminal BIAS OUT does not become 0 V owing to the ON resistance of the NMOS transistor 201.

Figure 12:
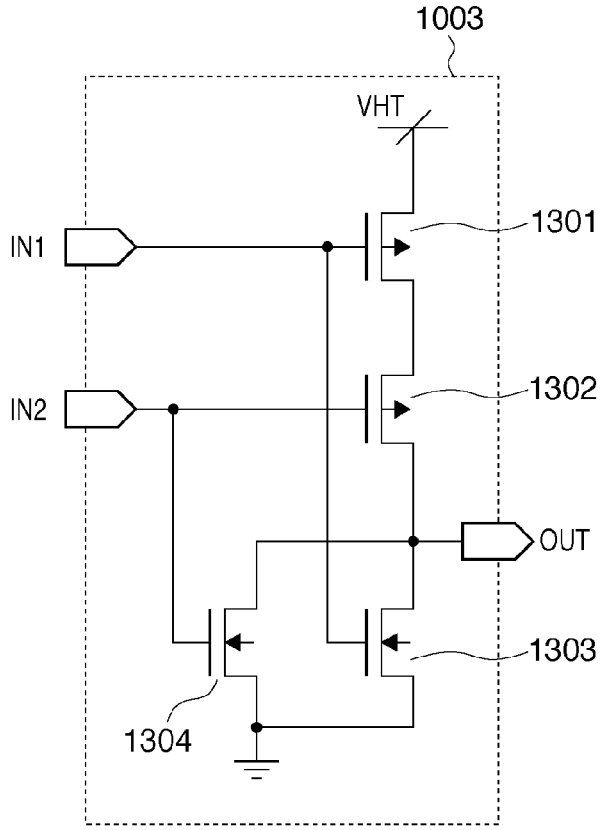
FIG. 12 PRIOR ART
FIG. 12 is a circuit diagram showing a conventional heater selection circuit.
Figure 13:
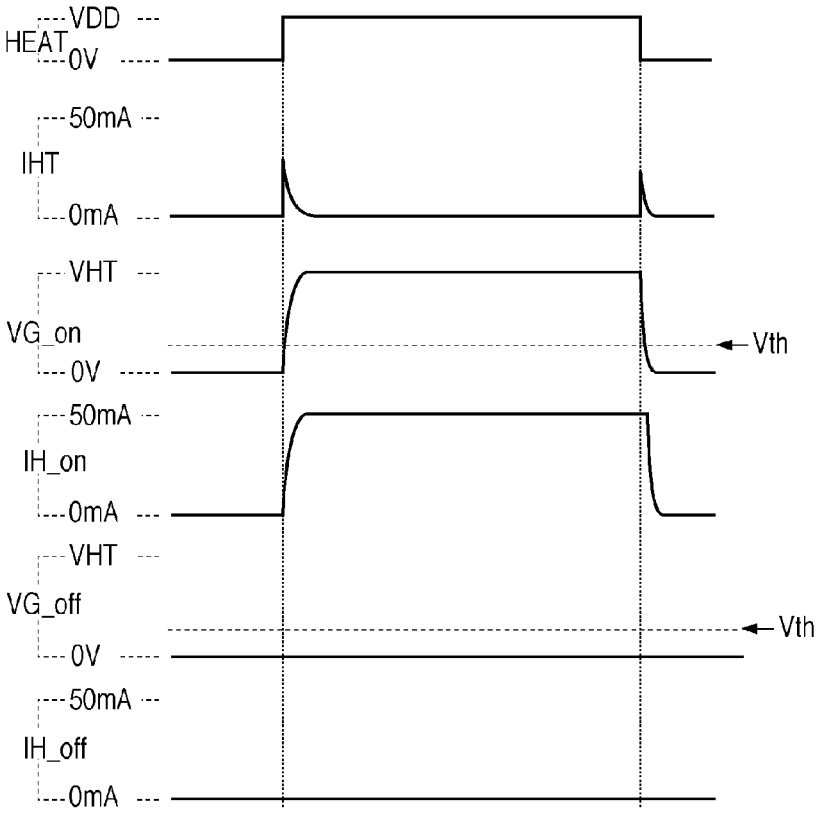
FIG. 13 PRIOR ART
FIG. 13 is a timing chart when driving a heater on a conventional element substrate.

The output voltage from the terminal BIAS OUT when the voltage conversion circuit B outputs logical signal level Low can be set by the MOS sizes of the PMOS transistor 202 and NMOS transistor 201. This output voltage is set between a voltage Vuc under the influence of the ON resistance of the NMOS transistor 201 and the threshold voltage Vth of the PMOS transistor 202. Assume that a signal which is boosted using the voltage conversion circuit B and has an amplitude of Vuc to VHT is input to the terminals IN1 and IN2 of a two-input NOR circuit in FIG. 12. The PMOS transistor receives a voltage lower than the threshold voltage, and normally performs a switching operation. However, the NMOS transistor sometimes does not receive a voltage lower than the threshold voltage at which it operates stably. Thus, the NMOS transistor does not always perform a switching operation normally.

Figure 3:
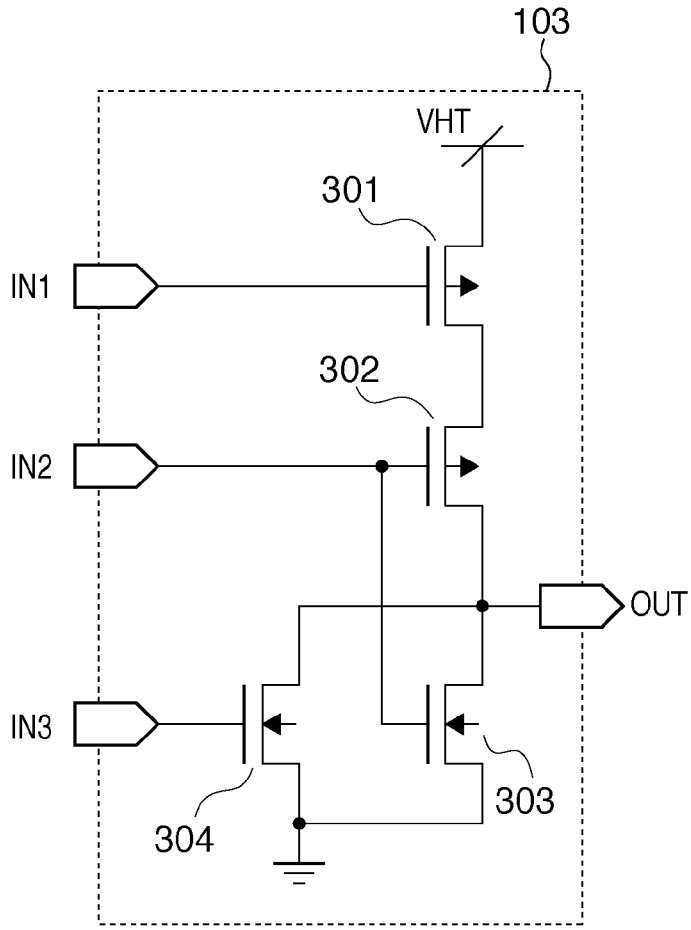
FIG. 3 is a circuit diagram showing a heater selection circuit according to the first embodiment of the present invention.

When the number of building elements of the voltage conversion circuit is decreased as shown in FIG. 2 in order to reduce the area of the element substrate by decreasing the length in a direction perpendicular to the nozzle arrayed direction, the voltage when outputting logical signal level Low does not become 0 V. The voltage output from the voltage conversion circuit ranges from Vuc to VHT. As a result, the 2-input NOR circuit used as a heater selection circuit may not operate normally. Hence, the voltage conversion circuit which decreases the number of building elements newly requires a heater selection circuit capable of selecting a heater by using a signal with an amplitude of Vuc to VHT. The first embodiment, therefore, adopts the heater selection circuit 103 as shown in FIG. 3.

A print data signal with an amplitude of VDD is input to the terminal CHARGE, and a logic-inverted signal is output from the terminal BIAS OUT of the circuit serving as a negative logic circuit. The voltage of the output signal ranges not from 0 V to VHT but from Vuc to VHT, unlike the conventional voltage conversion circuit. The print data signal output from the voltage conversion circuit B 108 is input to the terminals IN1 of N heater selection circuits 103 in the same group as that of the voltage conversion circuit B 108.

The terminal IN1 of each heater selection circuit 103 receives a signal with a voltage of Vuc to VHT that is converted by the voltage conversion circuit B 108. The terminal IN2 receives a block selection signal BLE with a voltage of 0

V to VHT that is converted by a voltage conversion circuit A 107. The block selection signal is used to time-divisionally drive a plurality of heaters for each block. The terminal IN3 receives a print data signal with an amplitude of VDD. The heater selection circuit 103 selects a heater to be turned on in accordance with these three signals.

FIG. 3 shows the arrangement of the heater selection circuit 103.

The heater selection circuit 103 includes a PMOS transistor 301 having a gate connected to the terminal IN1. The heater selection circuit 103 includes a PMOS transistor 302 having a gate connected to the terminal IN2, a source connected to the drain of the PMOS transistor 301, and a drain connected to the terminal OUT serving as an output terminal. The heater selection circuit 103 also includes an NMOS transistor 303 having a gate connected to the gate of the PMOS transistor 302, a drain connected to the terminal OUT, and a source grounded. Further, the heater selection circuit 103 includes an NMOS transistor 304 having a gate connected to the terminal IN3, a drain connected to the terminal OUT, and a source grounded.

The operation of the heater selection circuit 103 will be described.

When not outputting a pulse of VHT from the terminal OUT (supplying no current to a heater), a signal of VHT is input to the terminal IN2, and a signal of VDD is input to the terminal IN3 to turn off the PMOS transistor 302. Then, the terminal OUT is disconnected from the power supply of the voltage VHT, and the NMOS transistors 303 and 304 are turned on. Charges at the terminal OUT move to ground via the NMOS transistors 303 and 304. As a result, the terminal OUT does not output a signal of a voltage capable of driving the switching element of the heater. The switching element is not turned on, and no current flows through the heater.

In contrast, when outputting a pulse (High) of VHT from the terminal OUT (supplying a current to a heater), a Low signal is input to the terminals IN1, IN2, and IN3. At this time, a signal of VDD is input to the terminal CHARGE of the voltage conversion circuit B. In response to this, the NMOS transistors 303 and 304 are turned off to disconnect the terminal OUT from ground. At this time, the PMOS transistors 301 and 302 are turned on. The voltage VHT is output to the terminal OUT to turn on the switching element, and the current flows through the heater.

Figure 5:
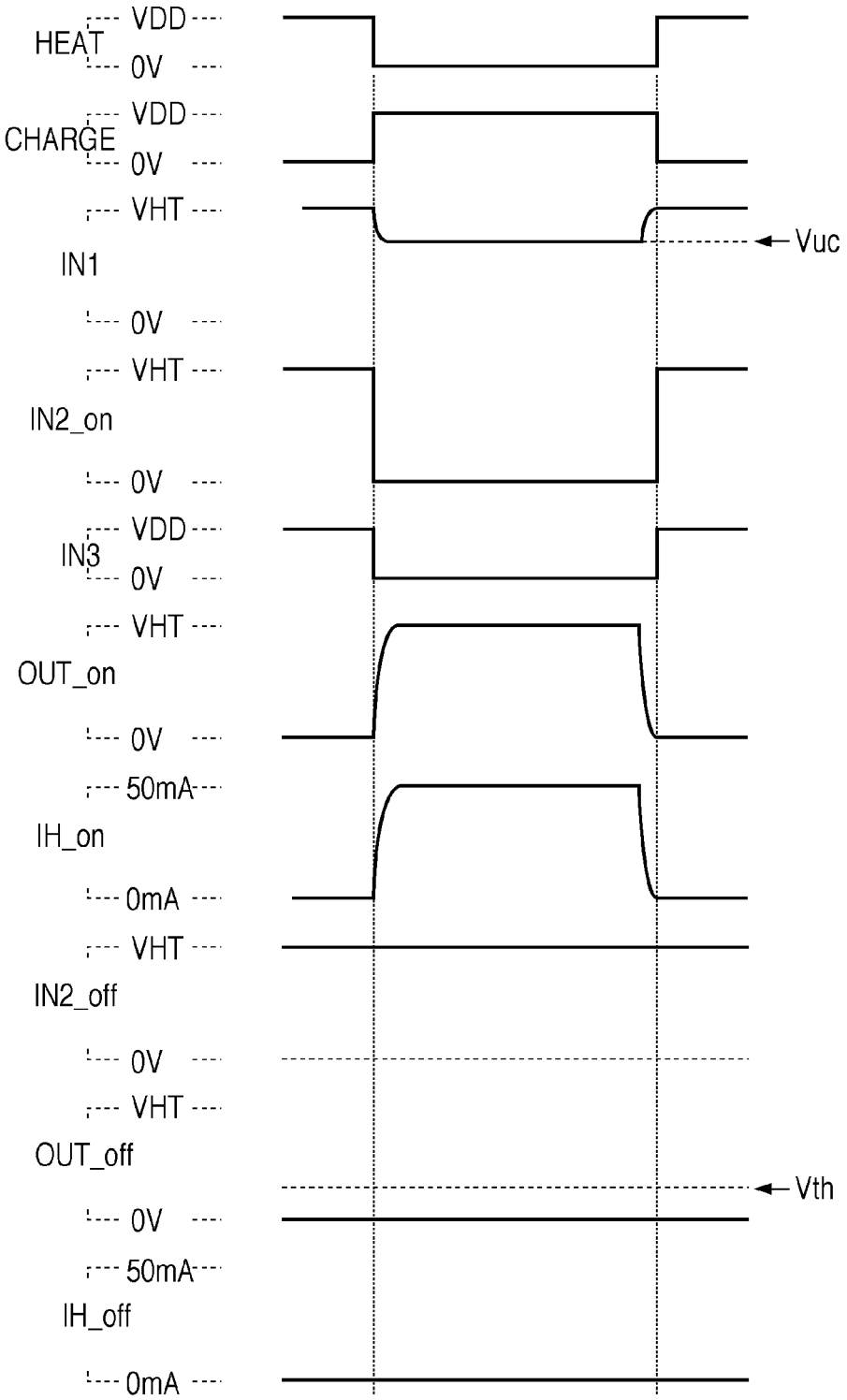
FIG. 5 is a timing chart showing an operation of driving a heater on an element substrate according to the first embodiment of the present invention.

FIG. 5 is a timing chart showing an operation of driving a heater on the above-described element substrate according to the first embodiment. The heater selection circuit used in the first embodiment can use the voltage conversion circuit B which receives signals with three different types of amplitudes to output a signal with an amplitude of Vuc to VHT.

Since Vuc is lower than a threshold voltage at which a PMOS transistor is turned on, the PMOS transistor can be switched even by a voltage of Vuc to VHT. A signal with a voltage of Vuc to VHT can therefore be used as an input signal to the gate of the PMOS transistor. However, Vuc cannot turn off an NMOS transistor, so an input signal to the gate of the NMOS transistor is set to have an amplitude of 0 V to VDD. Heater selection circuits in each group are connected so that in-phase signals with different amplitudes are commonly input to the terminals IN1 and IN3 of all the heater selection circuits in each group. In order to time-divisionally control heater driving, block selection signals BLE1 to BLEN with an amplitude of 0 V to VHT are input to IN2.

An operation until a heater is driven will be explained.

A print data signal HEAT output from a print data supply circuit to determine a timing to supply a driving current to a heater is input with an amplitude of 0 V to VDD to the terminal IN3 of the heater selection circuit. Further, a signal with an amplitude of 0 V to VDD opposite in phase to HEAT is input to the terminal CHARGE of the voltage conversion circuit B. In response to the timing of HEAT, the voltage conversion circuit B outputs a signal with an amplitude of Vuc to VHT to the terminal IN1 of the heater selection circuit. A block selection signal with an amplitude of 0 V to VHT boosted by the voltage conversion circuit A is input to the terminal IN2.

In a heater selection circuit corresponding to a heater selected as a heater to be driven, the signal level of the block selection signal changes to Low, as represented by IN2_on. An NMOS transistor serving as a switching element corresponding to the heater selected as a heater to be driven is connected to the terminal OUT of the heater selection circuit, and receives at its gate a signal with an amplitude of 0 V to VHT, as represented by OUT_on. The NMOS transistor serving as a switching element which receives OUT_on at its gate is turned on while a gate voltage equal to or higher than the threshold Vth is applied. A 50-mA current IH_on flows through the corresponding heater.

In a heater selection circuit corresponding to a heater not selected as a heater to be driven, the signal level of the block selection signal changes to High, as represented by IN2_off. No signal is output from the terminal OUT, as represented by OUT_off. No current flows through a corresponding heater, as represented by IH_off.

The speed at which the current IH flowing through a heater switches from ON to OFF is determined by the speed at which the NMOS transistors 303 and 304 of the heater selection circuit drain charges remaining in the NMOS transistors. The speed for draining charges becomes higher as the voltage applied to the gates of the NMOS transistors 303 and 304 becomes higher. Hence, a large amplitude of a signal input to the terminal IN3 quickens the fall of the waveform of the current IH flowing through a heater.

As described above, the first embodiment adopts a voltage conversion circuit B made up of two building elements as shown in FIG. 2. Compared to the voltage conversion circuit A made up of 10 building elements, the area occupied by the voltage conversion circuit can be reduced. The area of the element substrate can be reduced by decreasing the length in a direction perpendicular to the nozzle arrayed direction.

Since the number of building elements of the voltage conversion circuit decreases, the amplitude of a signal output from the voltage conversion circuit changes from the range of 0 V to VHT to the range of Vuc to VHT. A signal with an amplitude of Vuc to VHT cannot operate an NMOS transistor normally, so an element substrate having a conventional arrangement cannot employ a voltage conversion circuit like the voltage conversion circuit B. However, by using the above-described heater selection circuit, the element substrate according to the first embodiment can achieve the same operation as that of the conventional element substrate.

The first embodiment has exemplified an arrangement in which a shift register+latch 104 and block selection circuit 106 are arranged at the end on the shorter side of the element substrate. However, the present invention may also be applied to an element substrate in which the shift register+latch 104 and block selection circuit 106 are arranged along the nozzle arrayed direction.

The heater selection circuit used in the first embodiment receives three signals from the terminals IN1, IN2, and IN3. Of these signals, both the signals input from the terminals IN1 and IN3 are print data signals. The heater selection circuit used in the first embodiment substantially has a two-input circuit arrangement. The same effects can also be obtained by a circuit arrangement of three or more inputs, in addition to the two-input circuit arrangement.

Second Embodiment

The heater selection circuit according to the first embodiment employs a NOR arrangement in which a High signal is output from the terminal OUT when Low signals are input to the terminals IN1, IN2, and IN3. In the heater selection circuit according to the first embodiment, the PMOS transistors 301 and 302 are series-connected, and thus the ON resistance is high. An element substrate having this arrangement sometimes requires a relatively long time for driving building elements such as a switching element at high voltage.

To cope with this situation, the second embodiment inserts an inverter on the output stage of a heater selection circuit, improving the drivability of a switching element by an output signal from the heater selection circuit. However, when the inverter is inserted on the output stage, the logic is inverted. Unless an input signal to the inverter is Low, an output signal from the inverter does not become High. Hence, the second embodiment uses a heater selection circuit of the NAND arrangement which outputs Low logic, unlike the first embodiment using a heater selection circuit of the NOR arrangement which outputs High logic.

Figure 6:
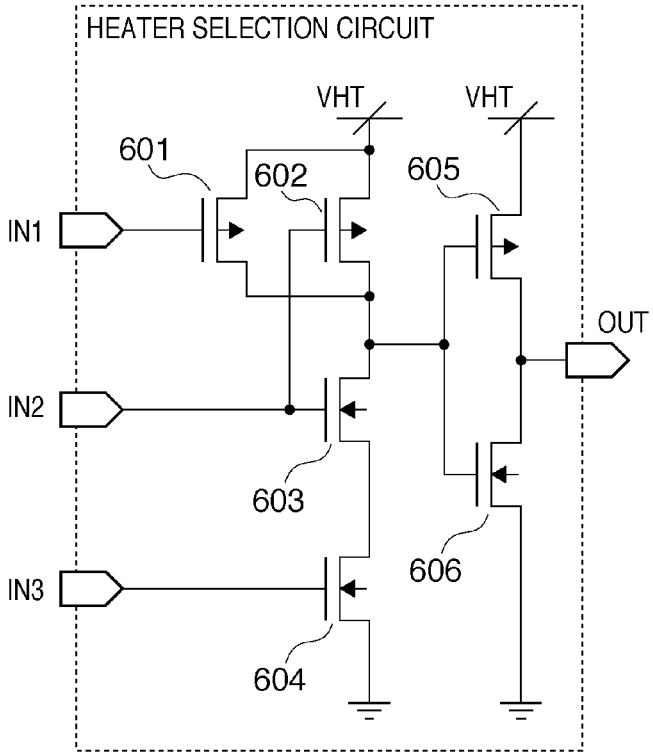
FIG. 6 is a circuit diagram showing a heater selection circuit according to the second embodiment of the present invention.

FIG. 6 shows the arrangement of a heater selection circuit according to the second embodiment.

The terminal IN1 receives a signal with a voltage of the BIAS OUT voltage Vuc to VHT output from a voltage conversion circuit B 108. Similarly, the terminal IN2 receives a signal with a voltage of 0 V to the voltage VHT (OUT) output from a voltage conversion circuit A 107. The terminal IN3 receives a signal HE with an amplitude of VDD. The heater selection circuit includes a PMOS transistor 601 having a gate connected to the terminal IN1, and a source connected to the power supply of the voltage VHT. The heater selection circuit includes a PMOS transistor 602 having a gate connected to the terminal IN2, and a drain and source parallel-connected to the PMOS transistor 601. The heater selection circuit also includes an NMOS transistor 603 having a drain connected to the drains of both the PMOS transistors 601 and 602, and a gate connected to the terminal IN2. The heater selection circuit includes an NMOS transistor 604 having a drain connected to the source of the NMOS transistor 603, a source grounded, and a gate connected to the terminal IN3. These four MOS transistors form a NAND circuit. An inverter is arranged on the next stage of the NAND circuit. The inverter is formed from a PMOS transistor 605 having a source connected to the power supply of the voltage VHT, and an NMOS transistor 606 having a drain and gate respectively connected to the drain and gate of the PMOS transistor 605, and a source grounded. The node between the drains of the PMOS transistor 602 and NMOS transistor 603 is connected to that between the gates of the PMOS transistor 605 and NMOS transistor 606.

The operation of the heater selection circuit employed in the second embodiment will be explained.

When not outputting a pulse with an amplitude of VHT from the terminal OUT (supplying no current to a heater), an output signal from the NAND circuit changes to High because the inverter inverts the logic. A Low-logic signal is input to the terminals IN1 and IN3 or the terminal IN2. Then, at least either the PMOS transistor 601 or 602 is turned on, and the voltage of the output signal from the NAND circuit becomes VHT. Note that the terminals IN1 and IN3 receive a signal of the same logic. At least either the NMOS transistor 603 or 604 is turned off to disconnect the NAND circuit from ground. As a result, an output signal from the NAND circuit changes to High. The inverter inverts the logic of the output signal from the NAND circuit, and an output signal from the heater selection circuit changes to Low. The Low output signal from the heater selection circuit does not turn on the NMOS transistor serving as a switching element, and no current flows through the heater.

When outputting a pulse with an amplitude of VHT from the terminal OUT (supplying a current to a heater), an output signal from the NAND circuit changes to Low because the inverter inverts the logic. A High-logic signal is input to the terminals IN1, IN2, and IN3. Then, the PMOS transistors 601 and 602 are turned off to disconnect the NAND circuit from the power supply of the voltage VHT. At this time, a Low-logic signal is input to the terminal CHARGE of the voltage conversion circuit B. The NMOS transistors 603 and 604 are turned on, so an output signal from the NAND circuit changes to a ground potential, that is, Low. The inverter on the next stage inverts the Low output signal from the NAND circuit, and an output signal from the heater selection circuit changes to High. The High output signal from the heater selection circuit turns on the NMOS transistor serving as a switching element, and the current flows through the heater.

The timing of an operation of driving a heater according to the second embodiment will be described. However, a description of the operation common to the first embodiment will not be repeated.

In a heater selection circuit corresponding to a heater selected as a heater to be driven, when HEAT is High and a signal of logical signal level High is input to the terminals IN2 and IN3, an output signal from the NAND circuit of the heater selection circuit becomes Low. In response to this, a signal output from the heater selection circuit becomes equal to or higher than the threshold Vth of the driving voltage of the switching element. Then, the switching element is turned on, and the current flows through the heater.

To the contrary, in a heater selection circuit corresponding to a heater not selected as a heater to be driven, a signal of logical signal level Low is input to at least one of the input terminals IN1, IN2, and IN3 of the heater selection circuit corresponding to the unselected heater. At this time, an output signal from the NAND circuit becomes High, and the voltage of a signal output from the terminal OUT of the heater selection circuit becomes 0 V. Hence, no current flows through the heater.

Third Embodiment

Figure 7:
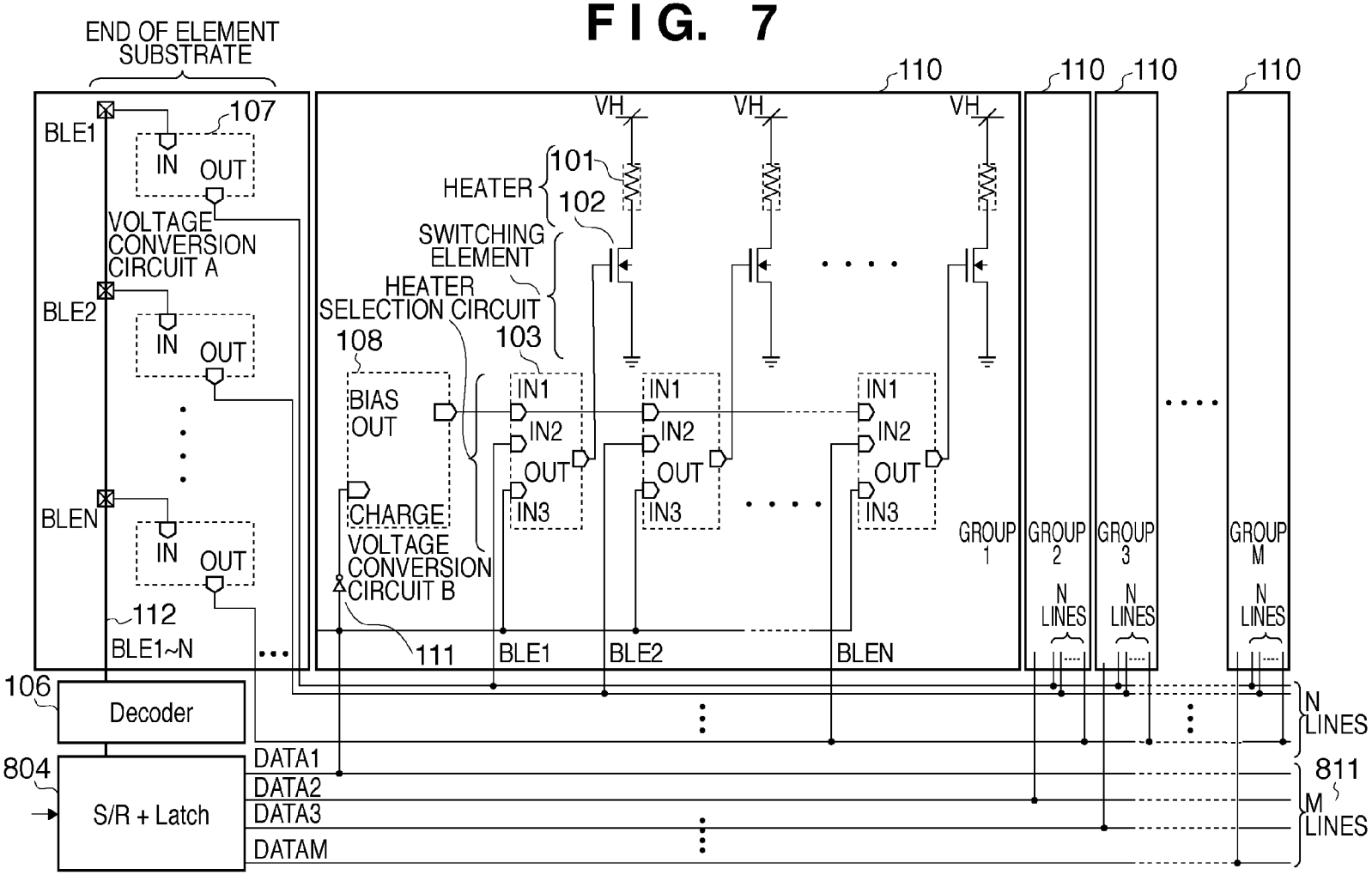
FIG. 7 is a block diagram showing an example of heaters and their driving control circuits according to the third embodiment of the present invention.
Figure 8:
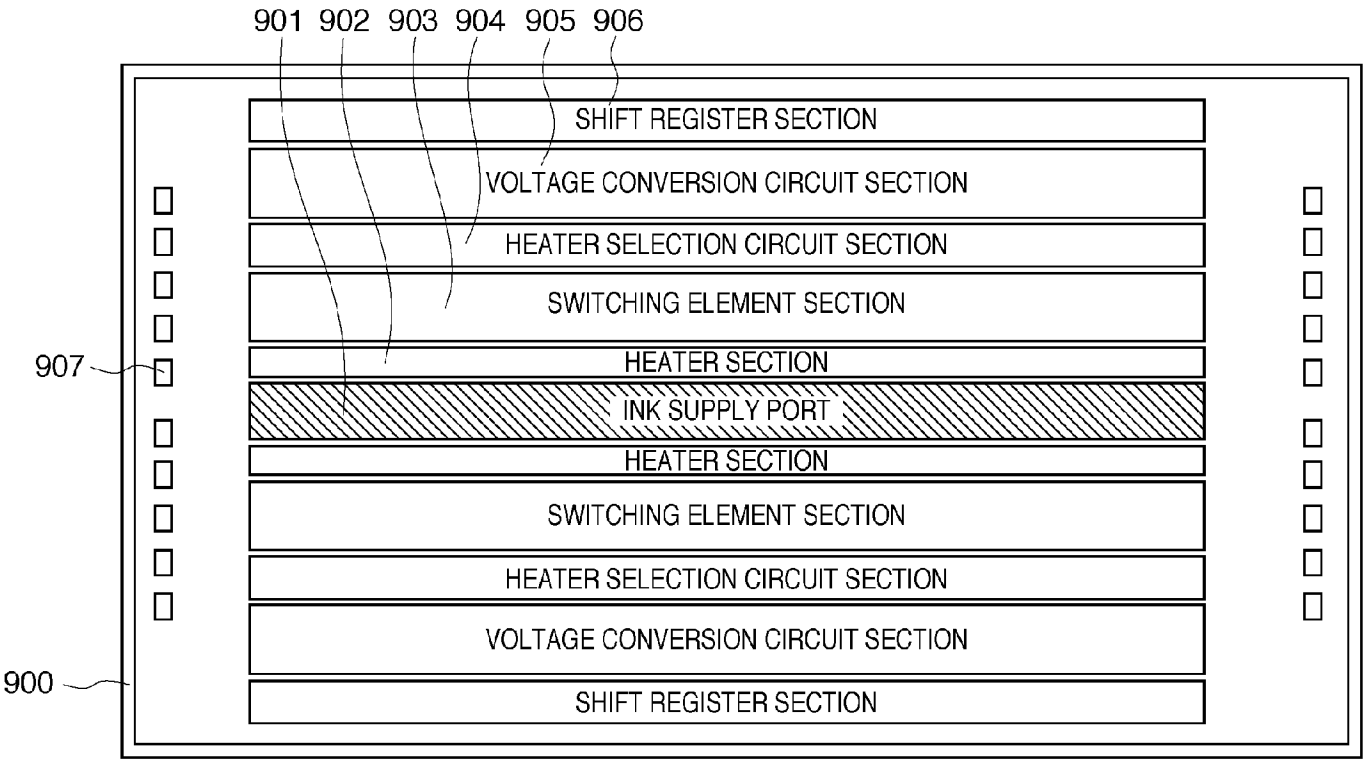
FIG. 8 PRIOR ART
FIG. 8 is a view showing an example of the layout of a conventional element substrate.

FIG. 7 is a block diagram showing an example of an equivalent circuit including a voltage conversion circuit A, a voltage conversion circuit B, a heater, a MOS transistor serving as a switching element, and a heater selection circuit, and is used for explaining the third embodiment. This block diagram schematically shows the layout of circuits on an element substrate.

On the element substrate of the third embodiment shown in FIG. 7, unlike the element substrate of the first embodiment shown in FIG. 1, the shift register+latch 104 and the 1-bit shift registers+latches 105 arranged for respective groups in FIG. 1 are combined into one shift register+latch 804. A description of the arrangement common to FIG. 1 will not be repeated.

In FIG. 7, the shift register+latch 804 stores, in synchronism with the clock signal, a block control signal input as a serial signal from the printing apparatus main body, and latches it in accordance with the latch signal. The output of the shift register+latch 804 for a print data signal with an amplitude of 0 V to VDD is commonly connected to the inputs of voltage conversion circuits B 108 and heater selection circuits 103 in groups 1 to M.

The element substrate according to the third embodiment is characterized in that the shift register+latch 804 is arranged at the end of the element substrate. The area of the wiring region of output wiring lines 811 extending from the shift register+latch 804 becomes smaller than the area occupied by the 1-bit shift registers+latches 105 in the first embodiment.

The above-described embodiments have exemplified an NMOS transistor as a switching element. However, the same effects can also be obtained when a PMOS transistor is used as a switching element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-306302, filed Nov. 27, 2007, which is hereby incorporated by reference herein in its entirety.

What is claimed is:

1. An element substrate having a plurality of heaters, and a plurality of switching elements corresponding to the plurality of heaters, the substrate comprising:

an inverter which receives a print data signal, inverts logic of the print data signal, and outputs an inverted signal;

a voltage conversion circuit which receives the inverted signal, inverts logic of the inverted signal, converts a voltage of the logic-inverted signal, and outputs the voltage-converted signal;

a block selection circuit which outputs a block selection signal for time-divisionally driving the plurality of heaters for each block; and heater selection circuits, arranged in correspondence with the plurality of switching elements, which receive the signal output from said voltage conversion circuit, the block selection signal, and the print data signal, and output signals for performing switching by the plurality of switching elements, wherein said voltage conversion circuit includes:

an NMOS transistor having a gate connected to an input terminal of the inverted signal, and a source grounded; and a PMOS transistor, series-connected to said NMOS transistor, which has a source connected to a power supply for outputting a voltage for driving the plurality of switching elements, and a gate and drain short-circuited, and each of said heater selection circuits includes:

a PMOS transistor having a gate connected to an input terminal of the signal output from said voltage conversion circuit, and a source connected to the power supply for outputting the voltage for driving the plurality of switching elements;

a PMOS transistor, series-connected to said PMOS transistor, which has a gate connected to an input terminal of the block selection signal, and a drain connected to an output terminal of the signal for performing the switching;

an NMOS transistor having a gate connected to an input terminal of the print data signal, a drain connected to the output terminal of the signal for performing the switching, and a source grounded; and an NMOS transistor, parallel-connected to said NMOS transistor, which has a gate connected to the input terminal of the block selection signal.

2. The element substrate according to claim 1, wherein said heater selection circuits and said voltage conversion circuit are arranged along an arrayed direction of the plurality of heaters.

3. The element substrate according to claim 1, further comprising a block selection signal voltage conversion circuit which receives the block selection signal output from said block selection circuit, converts a signal voltage, and outputs the voltage-converted signal, wherein said heater selection circuit receives the block selection signal output from said block selection signal voltage conversion circuit.

4. The element substrate according to claim 3, wherein said block selection signal voltage conversion circuit is arranged at an end on a shorter side of the element substrate.

5. A printhead using an element substrate according to claim 1.

6. A head cartridge comprising a printhead according to claim 5 and an ink tank containing ink.

* * * * *